US012144372B2

(12) United States Patent
Woodcock et al.

(10) Patent No.: US 12,144,372 B2
(45) Date of Patent: Nov. 19, 2024

(54) GENERATION OF AN INHALABLE MEDIUM

(71) Applicant: NICOVENTURES TRADING LIMITED, London (GB)

(72) Inventors: Dominic Woodcock, London (GB); Ugurhan Yilmaz, London (GB); David Bishop, London (GB)

(73) Assignee: NICOVENTURES TRADING LIMITED, London (GB)

( * ) Notice: Subject to any disclaimer, the term of this patent is extended or adjusted under 35 U.S.C. 154(b) by 801 days.

(21) Appl. No.: 17/250,528

(22) PCT Filed: Jul. 25, 2019

(86) PCT No.: PCT/EP2019/070017
§ 371 (c)(1),
(2) Date: Feb. 1, 2021

(87) PCT Pub. No.: WO2020/025434
PCT Pub. Date: Feb. 6, 2020

(65) Prior Publication Data

US 2021/0307386 A1 Oct. 7, 2021

(30) Foreign Application Priority Data

Jul. 30, 2018 (GB) ..... 1812373

(51) Int. Cl.
*A24F 40/30* (2020.01)
*A24F 40/42* (2020.01)
(Continued)

(52) U.S. Cl.
CPC ..... *A24F 40/30* (2020.01); *A24F 40/42* (2020.01); *A24F 40/46* (2020.01); *A24F 40/485* (2020.01)

(58) Field of Classification Search
CPC ..... A24F 40/30; A24F 40/485; A24F 40/46; A24F 40/42
(Continued)

(56) References Cited

U.S. PATENT DOCUMENTS 4,083,372 A 4/1978 Boden
4,284,089 A 8/1981 Ray
(Continued)

FOREIGN PATENT DOCUMENTS

AT 507187 A4 3/2010
AT 507187 B1 3/2010
(Continued)

OTHER PUBLICATIONS

International Search Report and Written Opinion for International Application No. PCT/EP2019/070017, mailed on Dec. 2, 2019, 13 pages.
(Continued)

*Primary Examiner* — Gary F Paumen
(74) *Attorney, Agent, or Firm* — Husch Blackwell

(57) ABSTRACT

Disclosed herein is a device for generating an inhalable medium, the device including a container for holding a liquid; a heater for volatilizing liquid held in the container; a first chamber containing a first tobacco composition; a second chamber containing a second tobacco composition; and an outlet; wherein the device is configured such that in use, an inhalable medium passes out of the outlet, the medium including volatilized liquid in the form of a vapor and/or an aerosol and one or more constituents of at least one of the tobacco compositions; and such that the relative fluid flow rate through the first and second chambers changes during use.

22 Claims, 3 Drawing Sheets

(51) Int. Cl.
*A24F 40/46* (2020.01)
*A24F 40/485* (2020.01)

(58) Field of Classification Search
USPC ..... 131/329
See application file for complete search history.

(56) References Cited

U.S. PATENT DOCUMENTS

| | | | |
|---|---|---|---|
| 4,756,318 | A | 7/1988 | Clearman et al. |
| 4,907,606 | A | 3/1990 | Lilja et al. |
| 4,913,169 | A | 4/1990 | Templeton |
| 5,027,836 | A | 7/1991 | Shannon et al. |
| 5,027,839 | A | 7/1991 | Appell |
| 5,105,834 | A | 4/1992 | Saintsing et al. |
| 5,115,820 | A | 5/1992 | Hauser et al. |
| 5,203,355 | A | 4/1993 | Clearman et al. |
| 5,327,915 | A | 7/1994 | Porenski et al. |
| 5,613,505 | A | 3/1997 | Campbell et al. |
| 5,820,967 | A | 10/1998 | Gadkaree |
| 5,950,619 | A | 9/1999 | Van et al. |
| 6,095,558 | A | 8/2000 | Bayer et al. |
| 6,814,786 | B1 | 11/2004 | Zhuang et al. |
| 6,988,496 | B1 | 1/2006 | Eicher et al. |
| 7,160,366 | B2 | 1/2007 | Rawlinson et al. |
| 7,699,052 | B2 | 4/2010 | Schiewe et al. |
| 8,536,606 | B2 | 9/2013 | Kim |
| 8,833,364 | B2 | 9/2014 | Buchberger |
| 8,997,753 | B2 | 4/2015 | Li et al. |
| 9,259,031 | B2 | 2/2016 | Branton et al. |
| D761,998 | S | 7/2016 | Pinder |
| D768,915 | S | 10/2016 | Wright et al. |
| 9,456,632 | B2 | 10/2016 | Hon |
| D782,728 | S | 3/2017 | Pinder |
| D782,729 | S | 3/2017 | Wright et al. |
| D805,684 | S | 12/2017 | Thuery |
| 9,894,930 | B2 | 2/2018 | Bonici et al. |
| D815,342 | S | 4/2018 | Sutton |
| D818,635 | S | 5/2018 | Pinder et al. |
| D818,638 | S | 5/2018 | Wright et al. |
| D825,099 | S | 8/2018 | Wright et al. |
| D825,103 | S | 8/2018 | Wright et al. |
| 10,226,077 | B2 | 3/2019 | Matsumoto et al. |
| 10,375,996 | B2 | 8/2019 | Aoun et al. |
| 10,426,199 | B2 | 10/2019 | Turner et al. |
| 11,511,056 | B2 * | 11/2022 | Hepworth ..... A61M 15/06 |
| 2004/0194792 | A1 | 10/2004 | Zhuang et al. |
| 2005/0133051 | A1 | 6/2005 | Luan et al. |
| 2005/0133054 | A1 | 6/2005 | Fournier et al. |
| 2006/0144412 | A1 | 7/2006 | Mishra et al. |
| 2006/0201524 | A1 | 9/2006 | Zhang et al. |
| 2007/0023056 | A1 | 2/2007 | Cantrell et al. |
| 2007/0215168 | A1 | 9/2007 | Banerjee et al. |
| 2008/0092912 | A1 | 4/2008 | Robinson et al. |
| 2008/0110470 | A1 | 5/2008 | Zhuang et al. |
| 2008/0241255 | A1 | 10/2008 | Rose et al. |
| 2010/0024834 | A1 | 2/2010 | Oglesby et al. |
| 2011/0088707 | A1 | 4/2011 | Hajaligol |
| 2011/0226236 | A1 | 9/2011 | Buchberger |
| 2012/0006342 | A1 | 1/2012 | Rose et al. |
| 2012/0006346 | A1 | 1/2012 | Inagaki |
| 2012/0042885 | A1 | 2/2012 | Stone et al. |
| 2012/0199663 | A1 | 8/2012 | Qiu |
| 2012/0255567 | A1 | 10/2012 | Rose et al. |
| 2012/0312314 | A1 | 12/2012 | Plakidis et al. |
| 2012/0318882 | A1 | 12/2012 | Abehasera |
| 2013/0014772 | A1 | 1/2013 | Liu |
| 2013/0056013 | A1 | 3/2013 | Terry et al. |
| 2013/0133675 | A1 | 5/2013 | Shinozaki et al. |
| 2013/0160779 | A1 | 6/2013 | Chida et al. |
| 2013/0160780 | A1 | 6/2013 | Matsumoto et al. |
| 2013/0192616 | A1 | 8/2013 | Tucker et al. |
| 2013/0192620 | A1 | 8/2013 | Tucker et al. |
| 2013/0298905 | A1 | 11/2013 | Levin et al. |
| 2013/0333700 | A1 | 12/2013 | Buchberger |
| 2014/0048085 | A1 | 2/2014 | Cox |
| 2014/0076340 | A1 | 3/2014 | Kizer et al. |
| 2014/0123989 | A1 | 5/2014 | Lamothe |
| 2014/0159250 | A1 | 6/2014 | Nickerson |
| 2014/0166029 | A1 | 6/2014 | Weigensberg et al. |
| 2014/0190502 | A1 | 7/2014 | Liu |
| 2014/0238422 | A1 | 8/2014 | Plunkett et al. |
| 2014/0261486 | A1 | 9/2014 | Potter et al. |
| 2014/0299125 | A1 | 10/2014 | Buchberger |
| 2014/0305449 | A1 | 10/2014 | Plojoux et al. |
| 2014/0356607 | A1 | 12/2014 | Woodcock |
| 2015/0027454 | A1 | 1/2015 | Li et al. |
| 2015/0128973 | A1 | 5/2015 | Li et al. |
| 2015/0196059 | A1 | 7/2015 | Liu |
| 2015/0257447 | A1 | 9/2015 | Sullivan |
| 2015/0264979 | A1 | 9/2015 | Thorens et al. |
| 2015/0342256 | A1 | 12/2015 | Chen |
| 2015/0374035 | A1 | 12/2015 | Sanchez et al. |
| 2016/0020224 | A1 | 1/2016 | Kawamura et al. |
| 2016/0073692 | A1 | 3/2016 | Alarcon et al. |
| 2016/0120224 | A1 | 5/2016 | Mishra et al. |
| 2016/0135505 | A1 | 5/2016 | Li et al. |
| 2016/0143360 | A1 | 5/2016 | Sanchez et al. |
| 2016/0174610 | A1 | 6/2016 | Kuczaj |
| 2016/0205992 | A1 | 7/2016 | Bell et al. |
| 2016/0227837 | A1 | 8/2016 | Hammel et al. |
| 2016/0255879 | A1 | 9/2016 | Paprocki et al. |
| 2016/0324216 | A1 | 11/2016 | Li et al. |
| 2016/0353801 | A1 | 12/2016 | Zinovik et al. |
| 2017/0042221 | A1 | 2/2017 | England |
| 2017/0086506 | A1 | 3/2017 | Rado |
| 2017/0095624 | A1 | 4/2017 | Davidson et al. |
| 2017/0143038 | A1 | 5/2017 | Dickens |
| 2017/0156402 | A1 | 6/2017 | Liu |
| 2017/0238612 | A1 | 8/2017 | Daryani et al. |
| 2017/0251727 | A1 | 9/2017 | Nielsen |
| 2017/0280769 | A1 | 10/2017 | Li et al. |
| 2017/0319799 | A1 | 11/2017 | Yamada et al. |
| 2017/0347706 | A1 | 12/2017 | Aoun et al. |
| 2018/0027882 | A1 | 2/2018 | Hepworth et al. |
| 2018/0235276 | A1 | 8/2018 | Zuleta et al. |
| 2018/0279667 | A1 | 10/2018 | Mcadam et al. |
| 2018/0279678 | A1 | 10/2018 | Hepworth et al. |
| 2018/0325174 | A1 | 11/2018 | Sutton |
| 2018/0360122 | A1 | 12/2018 | Aoun et al. |
| 2018/0368478 | A1 | 12/2018 | Golovanova et al. |
| 2019/0230990 | A1 | 8/2019 | Hepworth |
| 2019/0254343 | A1 | 8/2019 | Hepworth et al. |
| 2019/0320718 | A1 | 10/2019 | Mlmaz et al. |
| 2019/0320725 | A1 | 10/2019 | England |

FOREIGN PATENT DOCUMENTS

| | | | |
|---|---|---|---|
| CA | 885796 | A | 11/1971 |
| CA | 2330782 | A1 | 7/2002 |
| CA | 2925645 | A1 | 4/2015 |
| CA | 2940842 | A1 | 9/2015 |
| CN | 1054887 | A | 10/1991 |
| CN | 101433818 | A | 5/2009 |
| CN | 101557728 | A | 10/2009 |
| CN | 102264249 | A | 11/2011 |
| CN | 102834027 | A | 12/2012 |
| CN | 103315402 | A | 9/2013 |
| CN | 103892467 | A | 7/2014 |
| CN | 203762287 | U | 8/2014 |
| CN | 104068474 | A | 10/2014 |
| CN | 104284606 | A | 1/2015 |
| CN | 104302197 | A | 1/2015 |
| CN | 204273243 | U | 4/2015 |
| CN | 204317492 | U | 5/2015 |
| CN | 104770876 | A | 7/2015 |
| CN | 204653789 | U | 9/2015 |
| CN | 104957779 | A | 10/2015 |
| CN | 105357995 | A | 2/2016 |
| CN | 105394816 | A | 3/2016 |
| CN | 105792688 | A | 7/2016 |
| CN | 105962423 | A | 9/2016 |
| DE | 2940535 | A1 | 10/1980 |
| EA | 019736 | B1 | 5/2014 |
| EP | 0174645 | A2 | 3/1986 |

(56) References Cited

FOREIGN PATENT DOCUMENTS

| | | | |
|---|---|---|---|
| EP | 0254551 | A1 | 1/1988 |
| EP | 0305788 | A1 | 3/1989 |
| EP | 0307118 | A1 | 3/1989 |
| EP | 0352106 | A2 | 1/1990 |
| EP | 0535695 | A2 | 4/1993 |
| EP | 0585016 | A1 | 3/1994 |
| EP | 0845220 | A1 | 6/1998 |
| EP | 1468618 | A1 | 10/2004 |
| EP | 2489391 | A1 | 8/2012 |
| EP | 2625974 | A1 | 8/2013 |
| EP | 2625975 | A1 | 8/2013 |
| EP | 2399637 | B1 | 10/2014 |
| EP | 2787848 | A1 | 10/2014 |
| EP | 2989912 | A1 | 3/2016 |
| EP | 3127443 | A1 | 2/2017 |
| GB | 2529201 | A | 2/2016 |
| JP | S4742449 | Y1 | 12/1972 |
| JP | S488231 | U | 1/1973 |
| JP | S488231 | B1 | 3/1973 |
| JP | S60237982 | A | 11/1985 |
| JP | S63193499 | U | 12/1988 |
| JP | H0664983 | A | 3/1994 |
| JP | 2001120250 | A | 5/2001 |
| JP | 2009191148 | A | 8/2009 |
| JP | 2010506594 | A | 3/2010 |
| JP | 2012506263 | A | 3/2012 |
| JP | 5247711 | B2 | 7/2013 |
| JP | 2013545474 | A | 12/2013 |
| JP | 2014511175 | A | 5/2014 |
| JP | 2014520542 | A | 8/2014 |
| JP | 2014529996 | A | 11/2014 |
| JP | 2015504667 | A | 2/2015 |
| JP | 2015509718 | A | 4/2015 |
| JP | 5714637 | B2 | 5/2015 |
| JP | 2015513393 | A | 5/2015 |
| JP | 2017511703 | A | 4/2017 |
| JP | 2017529896 | A | 10/2017 |
| JP | 2017538398 | A | 12/2017 |
| JP | 2018512117 | A | 5/2018 |
| JP | 2018512118 | A | 5/2018 |
| KR | 20120053521 | A | 5/2012 |
| KR | 20130052119 | A | 5/2013 |
| KR | 20140118982 | A | 10/2014 |
| KR | 20170125064 | A | 11/2017 |
| RU | 122254 | U1 | 11/2012 |
| RU | 2528945 | C1 | 9/2014 |
| RU | 2570499 | C2 | 12/2015 |
| RU | 2576015 | C2 | 2/2016 |
| RU | 2587073 | C2 | 6/2016 |
| WO | 9748293 | A1 | 12/1997 |
| WO | 9748296 | A1 | 12/1997 |
| WO | 9828994 | A1 | 7/1998 |
| WO | 0130184 | A1 | 5/2001 |
| WO | 03008068 | A1 | 1/2003 |
| WO | 03034847 | A1 | 5/2003 |
| WO | 03056949 | A1 | 7/2003 |
| WO | 2004086888 | A2 | 10/2004 |
| WO | 2004087309 | A1 | 10/2004 |
| WO | 2006048766 | A1 | 5/2006 |
| WO | 2006070291 | A2 | 7/2006 |
| WO | 2006072889 | A1 | 7/2006 |
| WO | 2006089404 | A1 | 8/2006 |
| WO | 2006097852 | A1 | 9/2006 |
| WO | 2006103404 | A1 | 10/2006 |
| WO | 2006109189 | A1 | 10/2006 |
| WO | 2007031876 | A2 | 3/2007 |
| WO | 2007036814 | A2 | 4/2007 |
| WO | 2007054167 | A1 | 5/2007 |
| WO | 2007069093 | A2 | 6/2007 |
| WO | 2008108889 | A1 | 9/2008 |
| WO | 2011034723 | A1 | 3/2011 |
| WO | 2011045609 | A1 | 4/2011 |
| WO | 2011160788 | A1 | 12/2011 |
| WO | 2012106739 | A1 | 8/2012 |
| WO | 2012134380 | A1 | 10/2012 |
| WO | 2012168699 | A1 | 12/2012 |
| WO | 2013034458 | A1 | 3/2013 |
| WO | 2013083638 | A1 | 6/2013 |
| WO | 2013098405 | A2 | 7/2013 |
| WO | 2013102309 | A1 | 7/2013 |
| WO | 2013116558 | A1 | 8/2013 |
| WO | 2013120565 | A2 | 8/2013 |
| WO | 2013155645 | A1 | 10/2013 |
| WO | 2013164705 | A1 | 11/2013 |
| WO | 2014116974 | A1 | 7/2014 |
| WO | 2014136872 | A1 | 9/2014 |
| WO | 2014139611 | A1 | 9/2014 |
| WO | 2014140273 | A2 | 9/2014 |
| WO | 2014140320 | A1 | 9/2014 |
| WO | 2014150773 | A1 | 9/2014 |
| WO | 2014159250 | A1 | 10/2014 |
| WO | WO-2014187763 | A1 | 11/2014 |
| WO | WO-2015038981 | A2 | 3/2015 |
| WO | 2015046385 | A1 | 4/2015 |
| WO | 2015062983 | A2 | 5/2015 |
| WO | 2015091258 | A1 | 6/2015 |
| WO | 2015128499 | A1 | 9/2015 |
| WO | 2015179388 | A1 | 11/2015 |
| WO | 2015188348 | A1 | 12/2015 |
| WO | WO-2016005602 | A1 | 1/2016 |
| WO | 2016024083 | A1 | 2/2016 |
| WO | 2016050244 | A1 | 4/2016 |
| WO | 2016062777 | A1 | 4/2016 |
| WO | 2016075748 | A1 | 5/2016 |
| WO | 2016079729 | A1 | 5/2016 |
| WO | 2016121143 | A1 | 8/2016 |
| WO | 2016124740 | A1 | 8/2016 |
| WO | 2016124741 | A1 | 8/2016 |
| WO | 2016135331 | A1 | 9/2016 |
| WO | 2016135342 | A2 | 9/2016 |
| WO | 2016135342 | A3 | 10/2016 |
| WO | 2016179376 | A1 | 11/2016 |
| WO | WO-2017055584 | A1 | 4/2017 |
| WO | WO-2017068100 | A1 | 4/2017 |
| WO | 2018033649 | A1 | 2/2018 |
| WO | 2018130391 | A1 | 7/2018 |

OTHER PUBLICATIONS

"Definition of "throughout"" , Merriam-Webster Dictionary, http://www.merriam-webster.com/dictionary/throughout , Mar. 7, 2015 , 15 pages.

"Examination Report received for Australian Patent Application No. 2015334902, 3, mailed on Dec. 22, 2017".

"Examination Report received for European Patent Application No. 15725399.8, dated Jun. 4, 2019".

"Extended European Search Report received for Application No. 18190846.8, mailed on Dec. 21, 2018".

"Extended European Search Report received for Application No. 21166365.3, mailed on Jul. 21, 2021".

"iFUSE—the Heat not Burnhybrid—Heat Not Burn" , Available at <https://heatnotburn.co.uk/ifuse-heat-not-burn-hybrid/> , Jan. 4, 2018 , pp. 1-15.

"International Preliminary Report on Patentability for Application No. PCT/EP2016/054232, mailed Jul. 3, 2017".

"International Preliminary Report on Patentability for Application No. PCT/GB2012/051257, mailed Jul. 12, 2013".

"International Preliminary Report on Patentability for Application No. PCT/GB2015/051253, mailed on Nov. 10, 2016".

"International Preliminary Report on Patentability received for PCT Patent Application No. PCT/EP2015/074395, mailed on May 4, 2017".

"International Preliminary Report on Patentability received for PCT Patent Application No. PCT/EP2016/054159, mailed on Jul. 14, 2017".

"International Preliminary Report on Patentability received for PCT Patent Application No. PCT/EP2016/073472, mailed on Apr. 3, 2018".

"International Preliminary Report on Patentability received for PCT Patent Application No. PCT/EP2017/077633, mailed on May 16, 2019".

(56) References Cited

OTHER PUBLICATIONS

"International Preliminary Report on Patentability received for PCT Patent Application No. PCT/EP2019/070009, mailed on Feb. 11, 2021".
"International Preliminary Report on Patentability received for PCT Patent Application No. PCT/EP2019/070017, mailed on Feb. 11, 2021".
"International Search Report and Written Opinion for Application No. PCT/GB2012/051257, mailed Sep. 17, 2012".
"International Search Report and Written Opinion received for PCT Patent Application No. PCT/EP2017/077633, mailed on Feb. 5, 2018".
"International Search Report and Written Opinion received for PCT Patent Application No. PCT/EP2019/070009, mailed on Nov. 6, 2019".
"International Search Report for Application No. PCT/EP2015/074395, mailed Feb. 1, 2016".
"International Search Report for Application No. PCT/EP2016/054159, mailed Jun. 9, 2016".
"International Search Report for Application No. PCT/EP2016/054232, mailed Aug. 24, 2016".
"International Search Report received for PCT Patent Application No. PCT/EP2016/073472, mailed on Jan. 31, 2017".
"International Search Report received for PCT Patent Application No. PCT/GB2015/051253, mailed on Nov. 16, 2015".
"Office Action mailed Jul. 2, 2018 for Chinese Application No. 201580023549.5".
"Office Action mailed Feb. 5, 2019 for Japanese Application No. 2017-522122".
"Office Action received for Australian Patent Application No. 2015334902, mailed on May 11, 2018".
"Office Action received for Australian Patent Application No. 2019200330, mailed on Apr. 14, 2020".
"Office Action received for Brazilian Patent Application No. 112017018446-0, mailed on Mar. 23, 2020".
"Office Action received for Canadian Patent Application No. 2,963,957, mailed on Mar. 16, 2018".
"Office Action received for Canadian Patent Application No. 3,042,128, mailed on Aug. 11, 2020".
"Office Action received for Chinese Patent Application No. 201580023949.5, mailed on Jul. 2, 2018".
"Office Action received for Chinese Patent Application No. 201680024542.X, mailed on Sep. 12, 2019".
"Office Action received for Chinese Patent Application No. 201680024577.3, mailed on Sep. 12, 2019".
"Office Action received for Chinese Patent Application No. 201680056939.7, mailed on Aug. 24, 2020".
"Office Action received for Chinese Patent Application No. 201680056939.7, mailed on Feb. 3, 2020".
"Office Action received for Chinese Patent Application No. 201780067522.5, mailed on Jan. 10, 2022".
"Office Action received for Chinese Patent Application No. 201780067522.5, mailed on Jan. 8, 2021".
"Office Action received for European Patent Application No. 15793718.6, mailed on Apr. 1, 2020".
"Office Action received for European Patent Application No. 15793718.6, mailed on Dec. 20, 2018".
"Office Action received for European Patent Application No. 16709731.0, mailed on Sep. 30, 2019".
"Office Action received for European Patent Application No. 18190846.8, mailed on Apr. 1, 2020".
"Office Action received for Japanese Application No. 2017-545230, mailed on Nov. 6, 2018".
"Office Action received for Japanese Patent Application No. 2017-522122, mailed on May 15, 2018".
"Office Action received for Japanese Patent Application No. 2017-545230, mailed on Jul. 30, 2019".
"Office Action received for Japanese Patent Application No. 2017-545230, mailed on Jun. 2, 2020".
"Office Action received for Japanese Patent Application No. 2017-545245, mailed on Oct. 30, 2018".
"Office Action received for Japanese Patent Application No. 2018-152380, mailed on Jun. 30, 2020".
"Office Action received for Japanese Patent Application No. 2018-515290, mailed on Jan. 21, 2020".
"Office Action received for Japanese Patent Application No. 2018-515290, mailed on May 7, 2019".
"Office Action received for Japanese Patent Application No. 2019-522376, mailed on Sep. 1, 2020".
"Office Action received for Japanese Patent Application No. 2021-505274, mailed on Apr. 12, 2022".
"Office Action received for Korean Patent Application No. 10-2017-7013874, mailed on Apr. 25, 2018".
"Office Action received for Korean Patent Application No. 1020177013874, mailed on Oct. 30, 2018".
"Office Action received for Korean Patent Application No. 10-2017-7027341, mailed on Apr. 26, 2019".
"Office Action received for New Zealand Patent Application No. 752875, mailed on Dec. 11, 2019".
"Office Action received for Russian Patent Application No. 2019116869, mailed on Dec. 5, 2019".
"Office Action received for Russian Patent Application No. 2021104828, mailed on Aug. 18, 2021".
"Partial International Search Report for Application No. PCT/EP2016/054232, mailed Jun. 22, 2016".
"Reasons of Rejection received for Korean Patent Application No. 10-2021-7005666, mailed on Feb. 27, 2023".
"Search Report mailed Mar. 21, 2016 for Great Britain Application No. 1517470.9".
"Search Report received for Great Britain Parent Application No. 1418817.1, mailed on Apr. 23, 2015".
"Search Report received for Japanese Patent Application No. 2019-522376, mailed on Aug. 20, 2020".
"Search Report received for Russian Patent Application No. 2018106929, mailed on Aug. 20, 2021".
"Written Opinion of the International Preliminary Examining Authority for Application No. PCT/GB2012/051257, mailed May 29, 2013".
"Written Opinion received for PCT Patent Application No. PCT/EP2015/074395, mailed on Feb. 1, 2016".
"Written Opinion received for PCT Patent Application No. PCT/EP2016/054159, mailed on Jun. 9, 2016".
"Written Opinion received for PCT Patent Application No. PCT/EP2016/054232, mailed on Aug. 24, 2016".
"Written Opinion received for PCT Patent Application No. PCT/EP2016/073472, mailed on Jan. 31, 2017".
"Written Opinion received for PCT Patent Application No. PCT/GB2015/051253, mailed on Nov. 16, 2015".
Aoun , "Application and File History for U.S. Appl. No. 15/521,082, filed Apr. 21, 2017".
Aoun , et al. , "Application and Filing Receipt for U.S. Appl. No. 16/058,604, filed Aug. 8, 2018".
Branton , "Application and File History for U.S. Appl. No. 14/124,637, filed Feb. 7, 2014,".
England , "Application and File History for U.S. Appl. No. 15/307,074, filed Oct. 27, 2016".
Hepworth , "Application and File History for U.S. Appl. No. 15/553,785, filed Aug. 25, 2017".
Jac Vapour , "Round Rubber Mouth Tips" , JAC Vapour E-Cigarettes & E-Liquids, retrieved from http://www.jacvapour.com/round-rubber-e-cig-mouth-tips , May 29, 2015 , 2 pages.
Turner , "Application and File History for U.S. Appl. No. 15/553,742, filed Aug. 25, 2017".

* cited by examiner

GENERATION OF AN INHALABLE MEDIUM

PRIORITY CLAIM

The present application is a National Phase entry of PCT Application No. PCT/EP2019/070017, filed Jul. 25, 2019, which claims priority from GB Patent Application No. 1812373.7, filed Jul. 30, 2018, each of which is hereby fully incorporated herein by reference.

TECHNICAL FIELD

The present disclosure relates, without limitation, to a device for generating an inhalable medium, a cartridge for use in a device for generating an inhalable medium, a method of generating an inhalable medium, a kit and a tobacco composition pod.

BACKGROUND

Smoking articles such as cigarettes, cigars and the like burn tobacco during use to create tobacco smoke. Alternatives to these types of articles, release compounds without burning to form an inhalable medium.

Examples of such products are heating devices include e-cigarette/heat-not-burn hybrid devices, also known as electronic tobacco hybrid devices. These hybrid devices contain a liquid which is vaporized by heating to produce an inhalable vapor or aerosol. The liquid may contain flavorings and/or aerosol-generating substances, such as glycerol and in some instances, nicotine. The vapor or aerosol passes through material in the device and entrains one or more constituents of a substrate material to produce the inhaled medium. The substrate material may be, for example, tobacco, other non-tobacco products or a combination, such as a blended mix, which may or may not contain nicotine.

SUMMARY

In some embodiments described herein, the disclosure provides a device for generating an inhalable medium, the device comprising: a container for holding a liquid; a heater for volatilizing liquid held in the container; a first chamber containing a first tobacco composition; a second chamber containing a second tobacco composition; and an outlet; wherein the device is configured such that in use, an inhalable medium passes out of the outlet, the medium comprising (i) volatilized liquid in the form of a vapor and/or an aerosol and (ii) one or more constituents of at least one of the tobacco compositions; and such that the relative fluid flow rate through the first and second chambers changes during use.

The device described herein may be referred to as an electronic tobacco hybrid device.

The disclosure also provides a cartridge for se in a device for generating an inhalable medium, the cartridge comprising a volatilizable liquid in a first container, a first tobacco composition in a first chamber and a second tobacco composition in a second chamber, wherein the cartridge is configured such that in use in the device, the relative fluid flow rate through the first and second chambers changes over time.

Suitably, the cartridge may be adapted for use in the device for generating an inhalable medium described herein.

The disclosure also provides a tobacco composition pod, containing a first tobacco composition in a first chamber and a second tobacco composition in a second chamber; wherein the tobacco composition pod is configured for use in a device for use in generating an inhalable medium, the device being such that the relative fluid flow rate through the first and second chambers changes during use.

In some cases, the pod is configured such that when installed in the device, the relative fluid flow rate through the first and second chambers changes during use.

Suitably, the tobacco composition pod may be adapted for use in the device for generating an inhalable medium described herein.

The disclosure also provides a kit comprising: (i) a liquid pod containing a volatilizable liquid; and (ii) a tobacco composition pod, containing a first tobacco composition in a first chamber and a second tobacco composition in a second chamber; wherein the liquid and tobacco composition pod are configured for use in a device for use in generating an inhalable medium, the device being such that in use, an inhalable medium is generated, the medium comprising (i) volatilized liquid from the liquid pod in the form of a vapor and/or an aerosol and (ii) one or more constituents of the tobacco compositions; the device being such that the relative fluid flow rate through the first and second chambers of the tobacco composition pod changes during use.

The disclosure also provides a method of generating an inhalable medium using a device comprising a container holding a liquid, a heater for volatilizing the liquid, a first chamber containing a first tobacco composition, a second chamber containing a second tobacco composition and an outlet, the method comprising: volatilizing the liquid held in the container; forming an inhalable medium, the inhalable medium comprising (a) the volatilized liquid in the form of at least one of a vapor and an aerosol and (b) one or more constituents of at least one of the tobacco compositions; and passing the inhalable medium out of the outlet; wherein the method additionally comprises changing the relative fluid flow rate through the first and second chambers during use.

The disclosure also provides a method of providing sustained release of nicotine from a device for generating an inhalable medium, the device comprising: a container for holding a liquid; a heater for volatilizing liquid held in the container; a first chamber containing a first tobacco composition; a second chamber containing a second tobacco composition; and an outlet; the device being configured such that in use, an inhalable medium passes out of the outlet, the medium comprising (i) volatilized liquid in the form of a vapor and/or an aerosol and (ii) one or more constituents of at least one of the tobacco compositions; and such that the relative fluid flow rate through the first and second chambers changes during use.

In some cases, the device, cartridge or tobacco composition pod is configured such that in use, liquid volatilized by the heater passes, in the form of at least one of a vapor and an aerosol, through the tobacco compositions to thereby entrain one or more constituents from the tobacco compositions to produce the inhalable medium which passes out of the outlet, wherein the relative flow rate of the of at least one vapor and/or aerosol through the first and second chambers changes during use.

To the extent that they are compatible, features described in relation to one aspect of the disclosure are explicitly disclosed in combination with each and every other aspect. For instance, features described in relation to the device, cartridge, tobacco composition pod or kit are explicitly disclosed in combination with the each of the others of the device, cartridge, tobacco composition pod and kit. Specifically, features of the tobacco compositions, volitizable liquid, and mechanisms for altering the relative flow rates through the first and second chambers in use described herein are explicitly disclosed in combination with the device, cartridge, tobacco pod and kit embodiments of the disclosure. Similarly, features described in relation to apparatus are explicitly disclosed in combination with method aspects of the disclosure, and vice versa.

Further features and advantages of the disclosure will become apparent from the following description of preferred embodiments of the disclosure, given by way of example only, which is made with reference to the accompanying drawings.

BRIEF DESCRIPTION OF THE DRAWINGS

Examples of devices, cartridges and tobacco pods for generating an inhalable medium according to the disclosure are described below with reference to the accompanying drawings, in which.

DETAILED DESCRIPTION

Figure 1A:
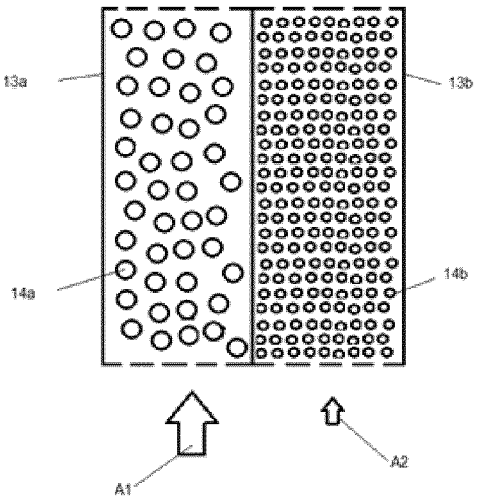
FIG. 1A shows a schematic cross-sectional view of an example tobacco composition pod for use in a device for generating an inhalable medium.

The present disclosure relates to improving the nicotine delivery profile per puff from a hybrid device. The inventors have established that in known devices, nicotine is rapidly volatilized at the beginning of the consumption period; the bulk of the nicotine is delivered to the user early in the consumption period and a significant decline of nicotine per puff is observed. In particular, pH-treated nicotine may be included in known devices (where the pH treatment forms a nicotine salt); the pH treatment liberates nicotine so that it is more readily volatilized on heating. However, such pH-treated tobacco is particularly susceptible to rapid volatilization and results in a particularly significant decline of nicotine delivery per puff.

The present disclosure provides a more consistent nicotine delivery profile. In particular, the present disclosure provides a more consistent nicotine delivery profile where the nicotine has been pH-treated.

The inventors have determined that through providing at least two tobacco compositions in a hybrid device, sustained delivery of nicotine can be achieved through altering, via passive or active means, the relative fluid flow rate through the respective tobacco compositions during use. Volatile tobacco constituents such as nicotine are entrained in the passing fluid in use; volatiles from a first tobacco composition with the faster initial relative fluid flow rate are initially delivered to the user and depletion of volatiles from the second tobacco composition is limited. Thus, volatiles from the second tobacco composition are retained and can be delivered to the user later; as the relative fluid flow rates change, a greater proportion of the delivered volatiles originate from the second tobacco composition.

In some cases, the device may comprise more than two chambers, each containing a tobacco composition. For example, the device may comprise three chambers, four chambers or five chambers. The relative fluid flow rate through the respective chambers changes during use.

In some cases, the initial fluid flow rate through the second chamber is substantially zero. In some cases, the final fluid flow rate through the first chamber is substantially zero.

In some cases, the device (or cartridge or tobacco composition pod) comprises a valve which is operable to direct fluid flow through the first or second chambers. In some cases, the valve may be manually actuated by the user to divert flow from the first chamber to the second chamber. In some cases, the valve may be actuated after a predetermined time period to divert flow from the first chamber to the second chamber. For example, the predetermined time period may be a time period after initiation of heating, or a time period after the first puff begins. In some cases, the valve may be actuated after a predetermined number of puffs to divert flow from the first chamber to the second chamber.

In some cases, the device (or cartridge or tobacco composition pod) comprises a degradable material which initially blocks fluid flow through the second chamber, wherein the degradable material is selected such that it degrades in use. For example, the degradable material may degrade in response to the heat and/or humid conditions that it is exposed to in use. For example, where the release is temperature triggered, the degradable material may be one that melts, dissolves, decomposes, reacts, degrades, swells or deforms at a temperature above room temperature but at or below the maximum temperature reached during use. Where the release is triggered by the humid conditions, (for example, through contact with the vapor or aerosol formed from the volatilized liquid), the release may be effected by a physical and/or chemical reaction between the vapor/aerosol and the degradable material. Suitable degradable materials include polysaccharides, cellulosic materials, gelatins, gums, gels, waxes and mixtures thereof. In some cases, the degradable material is selected from one or more of sucrose, alginates, dextran, maltodextrin, cyclodextrin, pectin, methyl cellulose, ethyl cellulose, hydroxyethyl cellulose, hydroxypropyl cellulose, carboxymethyl cellulose, cellulose ethers, gum Arabic, gum ghatti, gum tragacanth, Karaya, locust bean, acacia gum, guar, quince seed, xanthan gums, agar gel, agarose gel, carrageenans, furoidan, furcellaran, menthol and carnauba wax. The degradable material may degrade at, for example, above 50° C., suitably above 60° C., 70° C., 80° C. or 90° C. The degradable material may degrade suitably above room temperature or ambient temperature.

In some cases, the device (or cartridge or tobacco composition pod) comprises first and second tobacco compositions in the respective first and second chambers, wherein the initial average particle size of the tobacco composition in the first chamber is greater than the initial average particle size of the tobacco composition in the second chamber. In such cases, upon inhalation, the majority of the vapor/gas/aerosol will first be drawn through the first chamber (containing larger particles) where there is a lower resistance to flow. Over time, the large particles will absorb condensate (such as water) and expand, gradually increasing resistance to flow and consequently increasing the proportion of vapor/gas/aerosol that passes through the second chamber. Eventually, the large particles will swell to the extent that the second chamber (containing the small tobacco particles) has a lower resistance to flow and the majority of the inhaled tobacco constituents derive from the second tobacco composition.

In some cases, the device (or cartridge or tobacco composition pod) comprises a mesh in at least one of the chambers, wherein the mesh modulates the resistance to draw in that chamber.

For example, in some cases, the mesh size is selected such that the initial resistance to draw through that chamber is set by the mesh and is greater than the initial resistance to draw through the other chamber. In such cases, upon inhalation vapor/gas/aerosol will first be drawn through the first chamber where there is a lower resistance to flow. Over time, the tobacco particles will in that first chamber absorb moisture and expand, gradually increasing resistance to flow and consequently increasing the proportion of vapor/gas/aerosol that passes through the second chamber. Eventually, the particles swell to the extent that the second chamber has a lower resistance to flow and the majority of the inhaled tobacco constituents derive from the second tobacco composition.

In another example, the mesh size may be selected such that as tobacco particles in that chamber absorb condensates (such as moisture) and expand, the mesh becomes occluded. This increases the resistance to flow and consequently increases the proportion of vapor/gas/aerosol that passes through the other chamber.

In some cases, the device may comprise separate fluid flow paths, each leading from the container to a chamber containing a tobacco composition. Fluid may pass from the chamber into each flow path by means of a wick, and the relative fluid flow rate through the wicks over time may vary, thereby changing the fluid flow rate through the respective chambers. For example, a first wick may have a faster initial flow rate than a second wick, but the second wick may be positioned within the container so that it is in wicking contact with the liquid for longer during use.

In some cases, the device may comprise more than one container comprising liquid. Each container may be separately linked to a single chamber containing tobacco composition and, after a predetermined period of time, volatilization of liquid from a first container may terminate and volatilization of liquid from a second container may commence. This alters flow of fluid from the first chamber to the second chamber. In such cases, the volatilizable liquids may be different in the respective containers, or may be the same. The liquids may be heated by the same heating means or by different heating means.

The chambers containing tobacco compositions may be arranged in any suitable configuration. For example, the chambers may be arranged in a side-by-side configuration. In another example, the first chamber may be a central chamber with the second chamber arranged around the outside for that first chamber.

In some cases, the tobacco compositions in the first and second chambers may have substantially the same composition. In other cases, the tobacco compositions in the first and second chambers may have different compositions. In some cases, the tobacco compositions in the first and second chambers may have substantially the same chemical composition. In other cases, the tobacco compositions in the first and second chambers may have different chemical compositions. The compositions may differ, for example, to provide a desired puff profile, which may vary over time in flavor or strength.

In some cases, at least one of the tobacco compositions may be a pH-treated tobacco composition. pH treatment involves treatment with base to liberate nicotine. In some cases, the first and second tobacco compositions are pH-treated tobacco compositions.

In some cases, the tobacco composition may be porous, such that an aerosol or vapor can pass through the tobacco composition. Thus, components of the tobacco composition are efficiently entrained in the aerosol/vapor as it passes through the tobacco composition.

Each tobacco composition may comprise one or more tobacco material. As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco, agglomerated tobacco, spheronized tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

Each tobacco composition may additionally comprise flavorings and/or aerosol generating agents.

Each tobacco composition may additional comprise one or more casings, such as invert sugar, molasses, cane sugar, honey, cocoa, licorice, polyols such as glycerol and propylene glycol and acids such as malic acid.

The device comprises a container for holding a volatilizable liquid. In some cases, the device comprises a container which is holding a volatilizable liquid. Suitable liquids include those conventionally used in e-cigarette devices. In some cases, the volatilizable liquid may comprise nicotine and/or flavorings and/or aerosol-generating agents, such as propylene glycol and/or glycerol. The liquid is typically volatilized at around 150-250° C.

The device according to some examples of the invention may be configured such that in use, liquid volatilized by the heater passes, in the form of at least one of a vapor and an aerosol, through the tobacco compositions to thereby entrain one or more constituents from the tobacco compositions to produce the inhalable medium which passes out of the outlet.

In other examples, the flow path from the liquid container may be combined with a separate flow path which runs from the tobacco compositions so as to form the inhalable medium. In other words, in some example devices, the volatilized liquid does not pass through the chambers retaining the tobacco compositions.

In some cases, the device comprises means for heating the tobacco compositions to volatilize components of the tobacco and form a first aerosol and/or vapor. The liquid may be volatilized to form a second vapor and/or aerosol, which may be combined with the first vapor and/or aerosol to form the inhalable medium. In some cases, one heater may heat both the liquid and the tobacco compositions. In some cases, the device may be configured such that the heater only heats the liquid composition directly and the tobacco compositions are heated by warmth carried in the vapor/aerosol formed from the volatilized liquid (thereby volatilizing components of the tobacco composition which are then entrained in the vapor/aerosol flow).

In an embodiment, the device comprises a cooler or cooling zone downstream of the heater and upstream of the chambers, the cooler or cooling zone being arranged to cool vaporized liquid to form an aerosol of liquid droplets which in use passes through the tobacco composition in the chamber. The cooler may be arranged in effect to act as a heat exchanger, allowing for recovery of heat from the vapor. The recovered heat can be used for example to pre-heat the tobacco composition and/or to assist in heating the liquid.

In an embodiment, the device comprises a second heater for heating the tobacco compositions in the chambers. This enables the tobacco compositions to be heated by the heater, which encourages release of compounds from the tobacco compositions, and optionally allows a lower temperature to be used for the heated liquid.

In an embodiment, the device is battery-operated.

In an embodiment, the or each heater is an electrically resistive heater.

In an embodiment, the liquid container is removable. The liquid container may be in the form of a pot or the like (which in some embodiments may be annular for example), and/or an absorbent wadding or the like. The whole liquid container containing the liquid may in effect be a disposable item which is replaced as a whole after use. As an alternative, the arrangement may be such that the user removes the liquid container from the device, replaces used liquid or tops up liquid in the container, and then places the container back in the device.

In some cases, the liquid container may be non-removable from the device. In such an embodiment, the user may just replace used liquid or top up liquid in the container after use as necessary.

In some cases, the liquid container and the chambers are an integral unit. In some cases, the integral unit is a cartridge that can be removed from the device.

In some cases, the chambers are removable from the device. The chambers may be, for example, in the form of a cartridge or pod or the like which contains the tobacco composition before use. The chambers containing the tobacco compositions may in effect be a disposable item which is replaced as a whole after use. As an alternative, the arrangement may be such that the user removes the one or both chambers from the device, replaces used material in one or both of the chambers, and then places the one or both chambers back in the device.

Examples of cartridges, tobacco composition pods and devices for generating an inhalable medium according to the some embodiments of the invention will now be described, with reference to the accompanying drawings.

Figure 1B:
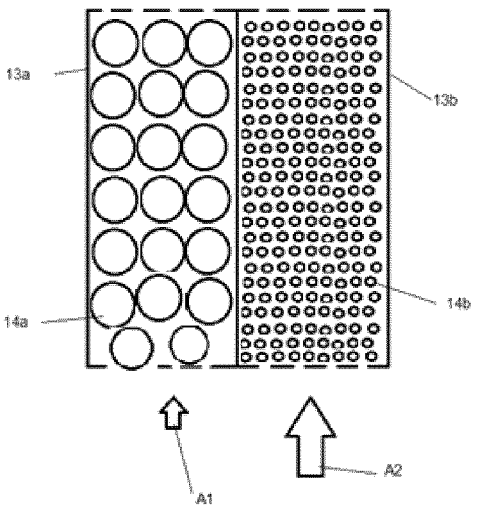
FIG. 1B shows a schematic cross-sectional view of the same example tobacco composition pod after a period of use in in a device for generating an inhalable medium.

Referring to FIGS. 1A and 1B, there is shown an example of a tobacco composition pod for use in a device for generating an inhalable medium. The pod comprises two chambers 13*a*, 13*b* each containing a tobacco composition 14*a*, 14*b* respectively. Initially, the tobacco composition 14*a* in the first chamber 13*a* has a larger average particle size that the tobacco composition 14*b* in the second chamber 13*b*. Consequently, the initial resistance to draw (RTD) through the first chamber 13*a* is lower than the second chamber 13*b* and thus the initial fluid flow A1 through the first chamber 13*a* is greater than the flow A2 through the second chamber. As illustrated in FIG. 1B, over time, the tobacco composition particles swell; in FIG. 1B, the tobacco composition 14*a* in the first chamber 14*b* has swelled to such an extent that the RTD through the first chamber 13*a* is greater than the second chamber 13*b*, and thus the fluid flow is greater through the second chamber 13*b* (A2>A1).

Figure 1C:
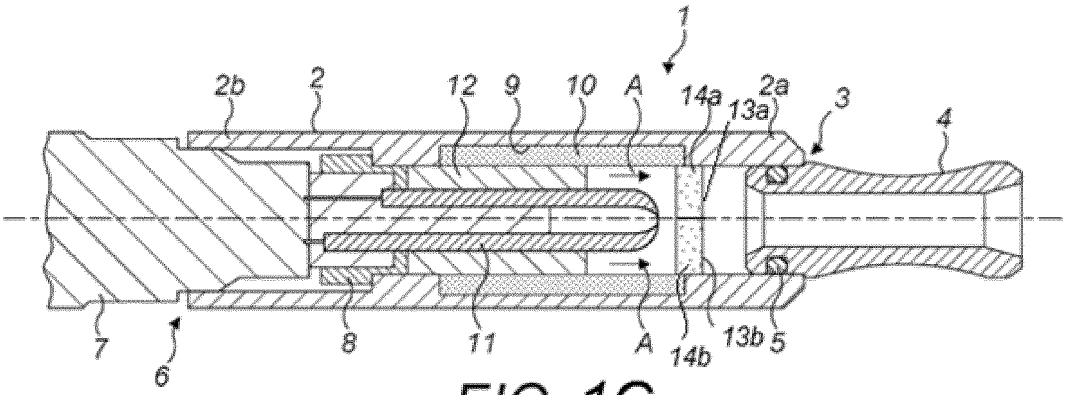
FIG. 1C shows a schematic longitudinal cross-sectional view of an example of a device for generating an inhalable medium.

Referring to FIG. 1C, there is shown an example of a device 1 for generating an inhalable medium in which a tobacco composition pod of the type illustrated in FIGS. 1A and 1B is incorporated. In broad outline, the device 1 volatilizes a liquid to form a vapor or an aerosol which passes through a material so as to produce an inhalable medium that contains one or more constituents derived from the material.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

Returning to FIG. 1, the device 1 of this example has a generally hollow cylindrical outer housing 2. The housing 2 has an open end 3. In this example, a tubular mouthpiece 4 is provided in the open end 3. The mouthpiece 4 in this example is removable by a user from the housing 2. An O-ring or other seal 5 assists in sealing the mouthpiece 4 in the housing 2. At or towards the other end 6 of the housing 2 is a battery 7 for powering various components of the device 1, as will be discussed further below. The battery 7 may be a rechargeable battery or a disposable battery. A controller 8 is also provided in the housing 2 for controlling the operation of various components of the device 1, as will be discussed further below.

The housing 2 has a container 9 for holding or containing a liquid 10. Various different forms for the container 9 may be used. In the example of FIG. 1, the container 9 is in the form of an annular chamber 9 provided in the housing 2 between the open end 3 and the other end 6. In this particular example, the housing 2 is in two parts, a first part 2*a* being towards the open end 3 and a second part 2*b* towards the other end 6. The first and second parts 2*a*,2*b* of the housing 2 may connect to each other via a screw thread, a bayonet fitting or the like. In use, a user can separate the first and second parts 2*a*,2*b* of the housing 2 to allow the liquid 10 to be replenished or replaced as necessary. Alternatively, the mouthpiece 4 can be removed to provide access to the container 9. It will be understood however that other arrangements are possible. For example, the liquid 10 may be provided in a discrete annular pot-like container which can be removed as a whole from the housing 2. Such a discrete container may be disposable so that the user replaces the liquid 10 by fitting a new container with liquid 10 in the housing 2. Alternatively, such a container may be reusable. In such a case, the user may replenish or replace liquid 10 in the container whilst it has been removed from the housing 2 and then replace the refilled container in the housing 2. It will be understood that the housing 2 need not be in two parts and that other arrangements enabling access for the user may be provided, for example, to enable refilling in situ.

A heater 11 is provided generally centrally of the housing 2, that is, centrally along the length and width of the housing 2 in this example. In this example, the heater 11 is powered by the battery 7 and is therefore electrically connected to the battery 7. The heater 11 may be an electrically resistive heater, including for example a nichrome resistive heater, a ceramic heater, etc. The heater 11 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements.

This heater 11 is provided for volatilizing the liquid 10. In the example shown, an annular wick 12 surrounds the heater 11 and is in (thermal) contact with the heater 11. The outermost surface of the annular wick 12 is in contact with liquid 10 contained in the liquid container 9. The wick 12 is generally absorbent and acts to draw in liquid 10 from the liquid container 9 by capillary action. The wick 12 is preferably non-woven and may be for example a cotton or wool material or the like, or a synthetic material, including for example polyester, nylon, viscose, or the like. The wick may alternatively be a ceramic or metallic material. Whilst this will be described more fully below, it may be noted here that in use, liquid 10 drawn into the wick 12 is heated by the heater 11. The liquid 10 may be volatilized so as to produce an aerosol of liquid droplets or sufficiently heated to produce a vapor. The aerosol or vapor so produced exits the wick 12 and passes towards the mouthpiece 4 as shown by the arrows A under the action of the user drawing on the mouthpiece 4. The heater 11 and wick 12 may be provided as a single, effectively integral item, sometimes referred to as an "atomizer", such that the heating and wicking is effectively carried out by a single unit.

The housing 2 further contains a two chambers 13*a*, 13*b* which hold or contain tobacco composition 14*a*, 14*b* in the device 1. In use, a user can access the chambers 13*a*, 13*b* to replace or replenish the tobacco compositions 14*a*, 14*b* through the open end 3 of the housing 2 by removing the mouthpiece 4 and/or by separating the two parts 2*a*, 2*b* of the housing 2. Various different forms for the chambers 13*a*, 13*b* may be used. For example, the chambers 13*a*, 13*b* may each be a tube which is completely open at both ends and which contain the tobacco compositions 14*a*, 14*b*. As another example, the chambers 13*a*, 13*b* may each be a tube which has one or more end walls which have through holes through which a vapor or aerosol can pass (as illustrated in FIGS. 1A and 1B). The chambers 13*a*, 13*b* may remain in situ within the housing 2 whilst the user removes and replaces the tobacco compositions 14*a*, 14*b*. Alternatively, the chambers 13*a*, 13*b* containing the tobacco compositions 14*a*, 14*b* may be a discrete item which in use is inserted into and removed from the housing 2 as a whole. Removable chambers 13*a*, 13*b* of this type may be disposable so that the user replaces the tobacco compositions 14*a*, 14*b* by fitting new chambers 13*a*, 13*b* containing fresh tobacco compositions into the housing 2. As an alternative, the chambers 13*a*, 13*b* may be reusable. In such a case, the user may replace the tobacco compositions 14*a*, 14*b* in the chambers 13*a*, 13*b* whilst the chambers have been removed from the housing 2 and then replace the refilled chambers 13 in the housing 2. In yet another example, the chambers 13*a*, 13*b* may comprise clips or the like provided internally of the housing 2 and which retain the tobacco compositions in position. In some examples, the tobacco compositions simply fit snugly within their respective chamber 13*a*, 13*b*. As another alternative, the container 9 for containing the liquid 10 may itself be arranged to support or carry the tobacco compositions 14*a*, 14*b*. For example, the container 9 may have one or more clips or a tube or the like for receiving and holding the tobacco compositions 14*a*, 14*b* in position. Such a dual function container 9/chamber or receptacle 13*a*, 13*b* for both containing the liquid 10 and receiving the tobacco compositions 14 may be in the form of a cartridge or the like and may be a disposable item or may be re-useable, with the liquid 10 and tobacco compositions 14*a*, 14*b* being replaced or topped up by the user as required. In some cases, it may be that the user only needs to top up or replace the tobacco compositions 14*a*, 14*b* from time to time, with sufficient liquid 10 being provided for several uses. Once the liquid 10 has been consumed, the user disposes of the dual function container 9/receptacle 13*a*, 13*b* and uses a new one. Likewise, it may be that the user only needs to top up or replace the liquid 10 from time to time, with sufficient tobacco composition being provided for several uses. Once the tobacco compositions have been consumed, the user disposes of the dual function container 9/receptacle 13*a*, 13*b* and uses a new one. Specific examples of dual function containers/receptacles are discussed further below.

The tobacco compositions 14*a*, 14*b* are located in the housing 2 downstream of the location where the aerosol or vapor is produced from the liquid 10 and upstream of the open end 3 of the housing 2 and the mouthpiece 4. In this particular example, the tobacco compositions 14*a*, 14*b* are effectively provided in the same portion or chamber of the housing 2 as the wick 12. The aerosol or vapor produced from the liquid 10 exits the wick 12 and passes as shown by the arrows A towards the tobacco compositions 14*a*, 14*b* under the action of the user drawing on the mouthpiece 4. In particular embodiments, the tobacco compositions are porous so that the aerosol or vapor passes through the tobacco compositions and then through the open end 3 of the housing 2 and the mouthpiece 4. The heat carried by the aerosol or vapor enhances volatilization of nicotine and other volatiles from the tobacco compositions, which are then entrained in the passing vapor/aerosol. Relative flow rates through the tobacco compositions 14*a*, 14*b* change during use; this may be by any mechanism described herein, such as that described and illustrated in relation to FIGS. 1A and 1B above.

In some embodiments, the tobacco compositions 14*a*, 14*b* and/or their chambers 13*a*, 13*b* are arranged so that there is no air gap between the tobacco compositions/chambers and the interior of the housing 2 so that the aerosol or vapor flows entirely through the tobacco compositions.

The liquid 10 is suitably a liquid that is volatilizable at reasonable temperatures, preferably in the range of 100-300° C. or more particularly around 150-250° C., as that helps to keen down the power consumption of the device 1. Suitable materials include those conventionally used in e-cigarette devices, including for example propylene glycol and glycerol (also known as glycerine).

The tobacco compositions 14*a*, 14*b* impart a flavor to the aerosol or vapor produced from the liquid 10 as the aerosol or vapor passes through them. As the aerosol or vapor passes through and over the tobacco compositions 14*a*, 14*b*, the hot aerosol or vapor entrains organic and other compounds or constituents from the material that lend tobacco its organoleptic properties, thus imparting the flavor to the aerosol or vapor as it passes to the mouthpiece 4.

The device 1 provides nicotine for the user. The nicotine may be provided in the liquid, may be obtained from the tobacco compositions, may be provided as a coating or the like on the tobacco compositions, or any combination of these. Likewise, flavorings may be added to the tobacco compositions and/or to the liquid.

In the example shown in FIG. 1C, the only heat source for heating the tobacco compositions 14*a*, 14*b* in the device 1, which is required so as to generate the organic and other compounds or constituents from the tobacco compositions, is the hot aerosol or vapor produced from heating the liquid 10.

Figure 2:
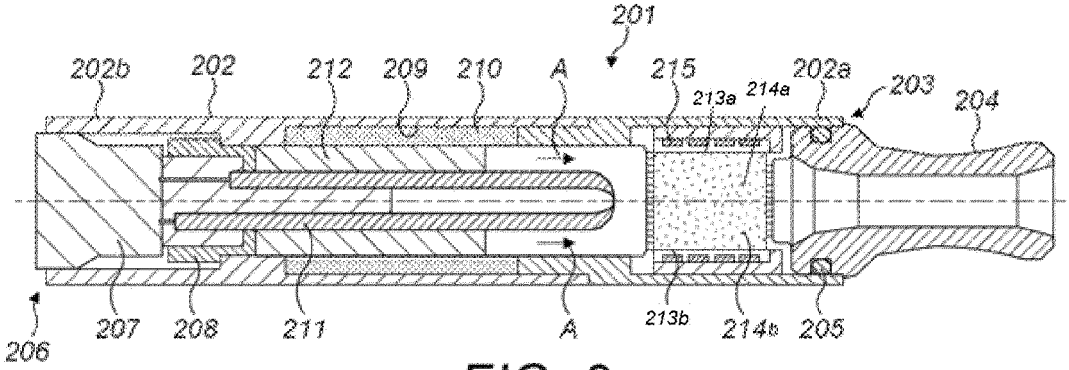
FIG. 2 shows a schematic longitudinal cross-sectional view of another example of a device for generating an inhalable medium.

Referring now to FIG. 2, there is shown another example of a device for generating an inhalable medium. In the following description and in FIG. 2, components and features that are the same as or similar to the corresponding components and features of the example described with reference to FIGS. 1A-1C have the same reference numeral but increased by 200. For the sake of brevity, the description of those components and features will not be repeated in its entirety here. It will be understood that the arrangements and alternatives, etc. described above in relation to the example of FIGS. 1A-1C are also applicable to the example of FIG. 2. Again, in broad outline, the device 201 of FIG. 2 heats a liquid to form a vapor or an aerosol which passes through a tobacco compositions 214*a*, 214*b* so as to produce an inhalable medium that contains one or more constituents derived from the tobacco compositions.

The device 201 of this example has a generally hollow cylindrical outer housing 202 with an open end 203 and a tubular mouthpiece 204. The mouthpiece 204 in this example is removable by a user from the housing 202 and an O-ring or other seal 205 assists in sealing the mouthpiece 204 in the housing 202. A battery 207 for powering various components of the device 201 and a controller 208 are provided at or towards the other end 206 of the housing 202. The housing 202 of this example is in two parts, a first part 202*a* being towards the open end 203 and a second part 202*b* towards the other end 206.

The housing 202 has a container 209 for holding or containing a liquid 210. The container 209 may be of any of the types described above in relation to the example of FIG. 1C. A heater 211 is provided generally centrally (lengthwise and widthwise) of the housing 202 for volatilizing the liquid 210. In this example, the heater 211 is powered by the battery 207 and is therefore electrically connected to the battery 207. The heater 211 may be an electrically resistive heater, a ceramic heater, etc. The heater 211 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including inductive heating arrangements or non-electrical heating arrangements. An annular wick 212 surrounds the heater 211 and is in (thermal) contact with the heater 211. The outermost surface of the annular wick 212 is in contact with liquid 210 contained in the liquid container 209. The liquid 210 may be heated so as to produce an aerosol of liquid droplets or sufficiently heated to produce a vapor. The aerosol or vapor so produced exits the wick 212 and passes towards the mouthpiece 204 as shown by the arrows A under the action of the user drawing on the mouthpiece 204. The heater 211 and wick 212 may be provided as a single, effectively integral item such that the heating and wicking is effectively carried out by a single unit.

The housing 202 further contains two chambers 213*a*, 213*b* which hold or contain tobacco compositions 214*a*, 214*b* in the device 201. The chambers 213*a*, 213*b* may be of any of the types described above in relation to the example of FIG. 1C. The tobacco compositions 214*a*,214*b* are located in the housing 202 downstream of the location where the aerosol or vapor is produced from the liquid 210 and upstream of the open end 203 of the housing 202 and the mouthpiece 204. In this particular example, the tobacco compositions 214*a*,214*b* are effectively provided in the same portion or chamber of the housing 202 as the wick 212. The aerosol or vapor produced from the liquid 210 exits the wick 212 and passes as shown by the arrows A towards the tobacco compositions under the action of the user drawing on the mouthpiece 204. In particular embodiments, the tobacco compositions 214*a*,214*b* are porous so that the aerosol or vapor passes through the tobacco compositions and then through the open end 203 of the housing 202 and the mouthpiece 204. The heat carried by the aerosol or vapor volatilizes nicotine and other volatiles from the tobacco compositions, which are then entrained in the passing vapor/aerosol. Relative flow rates through the tobacco compositions 214*a*,214*b* change during use; this may be by any mechanism described herein, such as that described and illustrated in relation to FIGS. 1A and 1B above.

In some embodiments, the tobacco compositions 214*a*, 214*b* and/or the chambers 213*a*,213*b* are arranged so that there is no air gap between the tobacco compositions/chambers and the interior of the housing 202 so that the aerosol or vapor flows entirely through the tobacco compositions. As the aerosol or vapor passes through and over the tobacco compositions 214*a*,214*b*, the hot aerosol or vapor entrains organic and other compounds or constituents from the tobacco compositions that lend tobacco its organoleptic properties, thus imparting the flavor to the aerosol or vapor as is passes to the mouthpiece 204.

In the example device 201 of FIG. 2, a second heater 215, such as an oven heater, is provided in thermal contact with the tobacco compositions 214*a*,214*b* to pre-heat the tobacco compositions and/or provide additional heat to the tobacco compositions throughout use of the device 201. This encourages release of constituents from the tobacco compositions as the vapor or aerosol passes through the tobacco compositions in use. The amount of heated liquid 210 to achieve desirable heating of the tobacco compositions may be reduced. The second heater 215 may be an electrically resistive heater, a ceramic heater, etc., powered by for example the battery 207. The second heater 215 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. The second heater 215 may be an inductive heater powered by for example the battery 207. Tobacco compositions 214*a*,214*b* may include materials susceptible to inductive heating. Other heating arrangements may be used for the second heater 215, including non-electrical heating arrangements.

The heater 215 may also effect volatilization of the nicotine or other volatiles from the tobacco compositions 214*a*,214*b*.

In the example device 201 of FIG. 2, the heater 215 for heating the tobacco compositions is provided externally of the tobacco compositions and heats the tobacco compositions by heat conduction from the exterior of the tobacco compositions. The heater 215 in this example is generally cylindrical. The heater 215 may in effect be an integral part of the device 201 and be provided as part of the housing 202. As an alternative, the heater 215 may be provided integrally with the chambers 213*a*,213*b* which hold or contain the tobacco compositions 214*a*,214*b*. In this alternative, in the case that the chambers 213*a*,213*b* are disposable, the heater 215 will be replaced when new chambers with fresh tobacco are loaded into the device 201 by the user.

Figure 3:
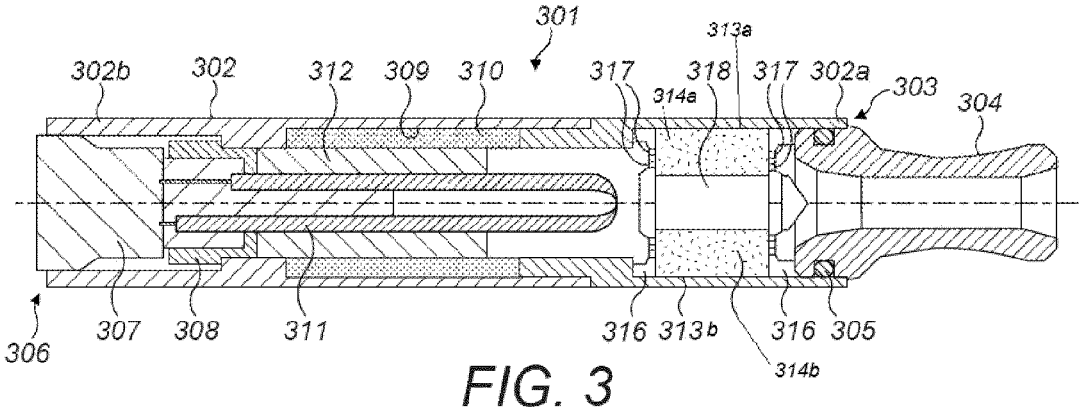
FIG. 3 shows a schematic longitudinal cross-sectional view of another example of a device for generating an inhalable medium.

Referring now to FIG. 3, there is shown another example of a device for generating an inhalable medium. In the following description and in FIG. 3, components and features that are the same as or similar to the corresponding components and features of the example described with reference to FIG. 1C have the same reference numeral but increased by 300. For the sake of brevity, the description of those components and features will not be repeated in its entirety here. It will be understood that the arrangements and alternatives, etc. described above in relation to the examples of FIG. 1C and FIG. 2 are also applicable to the example of FIG. 3. Again, in broad outline, the device 301 of FIG. 3 heats a liquid to form a vapor or an aerosol which passes through tobacco compositions 314*a*,314*b* so as to produce an inhalable medium that contains one or more constituents derived from the tobacco compositions.

The device 301 of this example again has a generally hollow cylindrical outer housing 302 with an open end 303 and a tubular mouthpiece 304, which is removable by a user from the housing 302. O-ring or other seal 305 assists in sealing the mouthpiece 304 in the housing 302. A battery 307 for powering various components of the device 301 and a controller 308 are provided at or towards the other end 306 of the housing 302. The housing 302 of this example is again in two parts, a first part 302*a* being towards the open end 303 and a second part 302*b* towards the other end 306.

The housing 302 has a container 309 for holding or containing a liquid 310. The container 309 may be of any of the types described above in relation to the examples of FIGS. 1 and 2. A heater 311 is provided generally centrally of the housing 302 for heating the liquid 310. The heater 311 may be any of the types described above. In this example, the heater 311 is powered by the battery 307 and is therefore electrically connected to the battery 307. An annular wick 312 surrounds the heater 311 and is in (thermal) contact with the heater 311. The outermost surface of the annular wick 312 is in contact with liquid 310 contained in the liquid container 309. The liquid 310 may be heated so as to produce an aerosol of liquid droplets or sufficiently heated to produce a vapor. The aerosol or vapor so produced exits the wick 312 and passes towards the mouthpiece 304 as shown by the arrows A under the action of the user drawing on the mouthpiece 304. The heater 311 and wick 312 may be provided as a single, effectively integral item such that the heating and wicking is effectively carried out by a single unit.

The housing 302 further contains two chambers 313*a*, 313*b* which hold or contain tobacco compositions 314*a*, 314*b* in the device 301. The chambers may be of any of the types described above in relation to the examples of FIGS. 1C and 2. (In the example shown in FIG. 3, the chambers 313*a*,313*b* are in the form of a tube which has end walls 316 which have through holes 317 through which a vapor or aerosol can pass, which was mentioned as an option above.) The tobacco compositions 314*a*,314*b* are located in the housing 302 downstream of the location where the aerosol or vapor is produced from the liquid 310 and upstream of the open end 303 of the housing 302 and the mouthpiece 304. In this particular example, again, the tobacco compositions are effectively provided in the same portion or chamber of the housing 302 as the wick 312. The aerosol or vapor produced from the liquid 310 exits the wick 312 and passes as shown by the arrows A towards the tobacco compositions under the action of the user drawing on the mouthpiece 304. In particular embodiments, the tobacco compositions 314*a*, 314*b* are porous so that the aerosol or vapor passes through the tobacco compositions and then through the open end 303 of the housing 302 and the mouthpiece 304. The heat carried by the aerosol or vapor volatilizes nicotine and other volatiles from the tobacco compositions, which are then entrained in the passing vapor/aerosol. Relative flow rates through the tobacco compositions 314*a*, 314*b* change during use; this may be by any mechanism described herein, such as that described and illustrated in relation to FIGS. 1A and 1B above.

In some embodiments, the tobacco compositions and/or the chambers are arranged so that there is no air gap between the tobacco compositions/chambers and the interior of the housing 302 so that the aerosol or vapor flows entirely through the tobacco compositions. As the aerosol or vapor passes through and over the tobacco compositions, the hot aerosol or vapor entrains organic and other compounds or constituents from the tobacco compositions, thus imparting tobacco flavor to the aerosol or vapor as is passes to the mouthpiece 304. The container 309 for containing the liquid 310 may itself be arranged to support or carry the tobacco compositions.

In the example device 301 of FIG. 3, a second heater 318 is again provided in thermal contact with the tobacco compositions 314*a*,314*b* to heat the tobacco compositions to encourage release of constituents from the tobacco compositions as the vapor or aerosol passes through the tobacco compositions in use. The second heater 318 may be an electrically resistive heater, a ceramic heater, etc., powered by for example the battery 307. Other heating arrangements may be used for the second heater 318, including non-electrical heating arrangements.

In the example device 301 of FIG. 3, the heater 318 for heating the tobacco compositions 314*a*,314*b* is provided internally of the tobacco compositions and heats the tobacco compositions by heat conduction from the interior of the tobacco compositions. The heater 318 in this example is generally in the form of a cylindrical rod located along the central longitudinal axis of the tobacco compositions. In other arrangements, the heater 318 may be a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. The tobacco compositions in this case are generally tubular or otherwise has an internal aperture for receiving the heater 318. The heater 318 may in effect be an integral part of the device 301 and be provided as part of the housing 302. In this case, as the tobacco compositions 314*a*, 314*b* are loaded into the device 301 (for example, as the chambers 313*a*, 313*b* containing the tobacco compositions are loaded into the device 301), the tobacco compositions surround the second heater 318. As an alternative, the heater 318 may be provided integrally with the chambers 313*a*,313*b*. In this alternative, in the case that the chambers are disposable, the heater 318 will be replaced when new chambers with fresh tobacco is loaded into the device 301 by the user.

In another example, plural internal heaters 318 may be provided, so as to provide for more efficient heating of the tobacco compositions. In another example, the tobacco compositions may be heated by both one or more external heaters (like the second heater 215 of the example of FIG. 2) and by one or more internal heaters (like the second heater 318 of the example of FIG. 3).

The one or more heaters 318 configured to heat the tobacco composition may volatilize nicotine or other volatiles from the tobacco compositions.

Figure 4:
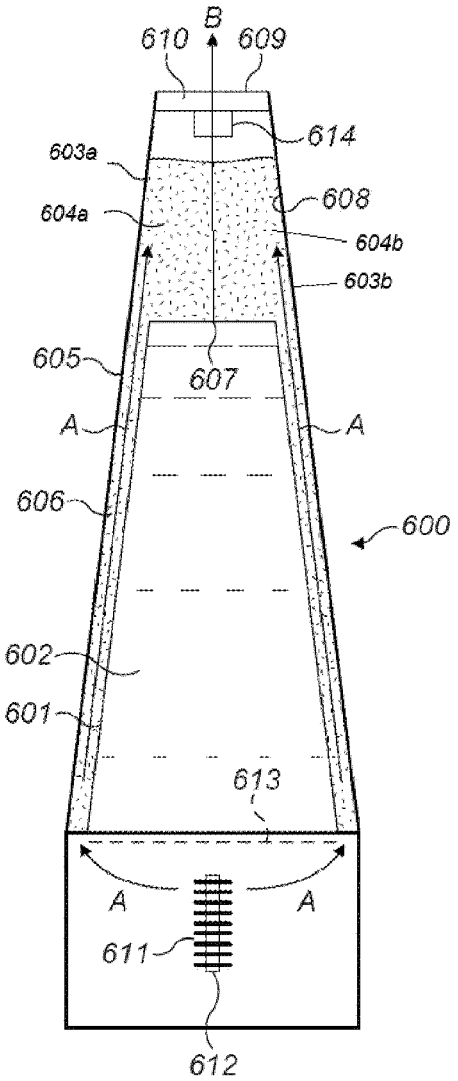
FIG. 4 shows a schematic longitudinal cross-sectional view of an example of a cartridge having a liquid container and an integral container for solid material.

Referring now to FIG. 4, there is shown a schematic longitudinal cross-sectional view of an example of a cartridge 600 having a liquid container 601 for containing liquid 602 and container 603*a*, 603*b* for tobacco compositions 604*a*,604*b*. In this example, the liquid container 601 and the tobacco composition containers 603 are provided as one integral component, either by being formed integrally initially or being formed initially of two or three parts which are then assembled in a substantially permanent fashion. The cartridge 600 is arranged so that as the liquid 602 is volatilized so as to produce an aerosol of liquid droplets or sufficiently heated to produce a vapor, at least some and preferably all or substantially all of the aerosol or vapor passes through the tobacco compositions 604*a*, 604*b* to pick up flavor from the tobacco compositions.

In the example of FIG. 4, the liquid container 601 is provided generally centrally of the cartridge 600. The liquid container 601 in the example shown is frustoconical in shape, but may have a different shape, such as conical, cylindrical, etc. The liquid container 601 is surrounded by an outer shell 605 which defines an annular channel 606 around the outside of the length of the liquid container 601 and which extends from one end of the liquid container 601 to the other. The outer shell 605 extends beyond a first end wall 607 of the liquid container 601 to define a chamber 608 beyond the first end wall 607 of the liquid container 601. The annular channel 606 and the chamber 608 are partitioned to divide the cavity into the two containers 603*a*,603*b* containing the tobacco compositions 604*a*,604*b*. In other examples, the tobacco compositions may be provided only in the chamber 608 which is partitioned from the containers 603*a*, 603*b*, and the annular channel 606 is empty. The chamber 608 is closed off by an end wall 609 which is spaced from the end wall 607 of the liquid container 601. The end wall 609 may be part of the outer shell 605 or may be a separate plastics or rubber cap or the like. In yet other examples, the annular channel 606 is partitioned to form the containers 603*a*, 603*b*; the tobacco compositions are provided in the channel 606 and there is no material in the chamber 608, and indeed the chamber 608 may be omitted and the channel 606 effectively terminates at the end wall 609. The channel 606 and/or chamber 608 may be entirely filled with the tobacco compositions or may only contain a portion or plug of material. The end wall 609 is porous and/or has one or more through holes 610 to enable the aerosol or vapor to exit the cartridge 600 to be inhaled by a user. The liquid container 601 and the solid chambers 603*a*,603*b* may each be formed of rigid, watertight and airtight materials, such as metal, suitable plastics, etc.

The example cartridge 600 shown in FIG. 4 is provided with a heater 611 and a wick 612 in (thermal) contact with the heater 611. In this example, the heater 611 and the wick 612 are provided as a single unit, often referred to as an "atomizer". In this case, where the cartridge 600 includes an atomizer, such a cartridge is often referred to as a "cartomizer". The orientation of the heater 611 is shown schematically and for example the heater 611 may be a coil having its longitudinal axis perpendicular to the longitudinal axis of the cartridge 600 rather than parallel as shown in FIG. 4.

The wick 612 is in contact with the liquid 602. This may be achieved by for example the wick 612 being inserted through a through hole (not shown) in the second end wall 613 of the liquid container 601. Alternatively or additionally, the second end wall 613 may be a porous member (shown schematically in FIG. 4 by dashed lines) which allows liquid to pass through from the liquid container 601, and the wick 612 may be in contact with the porous second end wall 613. The second end wall 613 may be for example in the form of a porous ceramic disk. A porous second end wall 613 of this type helps to regulate the flow of liquid onto the wick 612. The wick 612 is generally absorbent and acts to draw in liquid 602 from the liquid container 601 by capillary action. The wick 612 is preferably non-woven and may be for example a cotton or wool material or the like, or a synthetic material, including for example polyester, nylon, viscose, polypropylene or the like.

In use, the cartridge 600 is connected by the user to a battery section of a device (not shown) to enable the heater 611 to be powered. When the heater 611 of the atomizer is powered (which may be instigated for example by the user operating a button of the overall device or by a puff detector of the overall device, as is known per se), liquid 602 drawn in from the liquid container 601 by the wick 612 is heated by the heater 611 to volatilize or vaporize the liquid. As the user draws on a mouthpiece of the overall device, the vapor or aerosol passes into the annular channel 606 around the outside of the length of the liquid container 601 and into the chamber 608 as shown by the arrows A. The vapor or aerosol picks up flavor from the tobacco compositions 604*a*,604*b*. Relative flow rates through the tobacco compositions 604*a*, 604*b* change during use; this may be by any mechanism described herein, such as that described and illustrated in relation to FIGS. 1A and 1B above.

The heat carried by the aerosol or vapor volatilises nicotine and other volatiles from the tobacco compositions, and these are then entrained in the passing vapor/aerosol. The vapor or aerosol can then exit the cartridge 600 through the end wall 609 as shown by the arrow B. Optionally, a one way valve 614 may be provided inside the end wall 609 so that the vapor or aerosol can only exit the cartridge 600 and cannot back-flow to the heater 611 or the electronics of the device as a whole.

Figure 5:
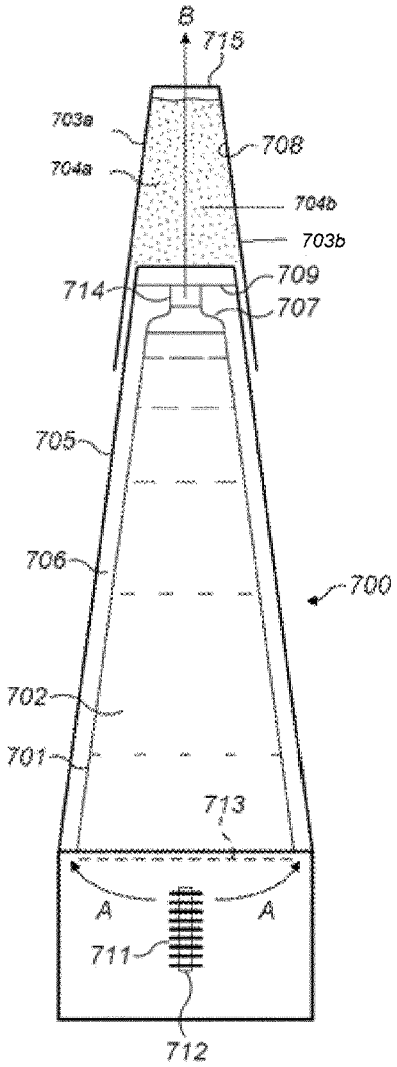
FIG. 5 shows a schematic longitudinal cross-sectional view of an example of a cartridge having a liquid container and a detachable container for solid material.

Referring now to FIG. 5, there is shown a schematic longitudinal cross-sectional view of another example of a cartridge 700 having a liquid container 701 for containing liquid 702 and two containers 703*a*, 703*b* defining a partitioned chamber 708. The containers each hold a tobacco composition 704*a*, 704*b*. In the following description and in FIG. 5, components and features that are the same as or similar to the corresponding components and features of the example described with reference to FIG. 4 have the same reference numeral but increased by 100. For the sake of brevity, the description of those components and features will not be repeated in its entirety here.

In this example, the liquid container 701 and the tobacco composition containers 703*a*, 703*b* of the cartridge 700 are provided as separate components, which are detachably connected to each other in use. The liquid container 701 and the tobacco composition containers 703*a*, 703*b* may for example be clipped or otherwise detachably fixed to each other, or for example the tobacco composition containers may simply rest on or be a tight friction fit on the liquid container 701. The cartridge 700 is arranged so that as the liquid 702 is volatilized so as to produce an aerosol of liquid droplets or sufficiently heated to produce a vapor, at least some and preferably all or substantially all of the aerosol or vapor passes through the tobacco compositions 704*a*, 704*b* to pick up flavor from the tobacco compositions. Relative flow rates through the tobacco compositions 704*a*, 704*b* change during use; this may be by any mechanism described herein, such as that described and illustrated in relation to FIGS. 1A and 1B above.

In this example, the liquid container 701 is surrounded by an outer shell 705 which defines an annular channel 706 around the outside of the length of the liquid container 701 and which extends from one end of the liquid container 701 to the other. The outer shell 705 extends beyond a first end wall 707 of the liquid container 701 and terminates in an end wall 709. The end wall 709 may be a separate plastics or rubber cap or the like. The end wall 709 is porous and/or has one or more through holes 710 to enable the aerosol or vapor to exit the annular channel 706. A one way valve 714 may be provided inside the end wall 709 so that the vapor or aerosol can only exit the annular channel 706 at the end remote from the heater 711 and wick 712 and cannot back-flow to the heater 711 or the electronics of the device as a whole. The tobacco composition containers 703*a*, 703*b* are located in use over the end wall 709 so that vapor or aerosol exiting through the end wall 709 passed into the tobacco composition containers. The tobacco composition containers have an exit aperture and/or or a porous end wall 715 to enable the aerosol or vapor to exit the cartridge 700 to be inhaled by a user.

In use, the cartridge 700 is connected by the user to a battery section of a device (not shown) to enable the heater 711 to be powered. When the heater 711 of the atomizer is powered (which may be instigated for example by the user operating a button of the overall device or by a puff detector of the overall device as is known per se), liquid 702 drawn in from the liquid container 701 through the end wall 713 by the wick 712 is heated by the heater 711 to volatilize or vaporize the liquid. As the user draws on a mouthpiece of the overall device, the vapor or aerosol passes into the annular channel 706 around the outside of the length of the liquid container 701 towards the end wall 709 of the outer shell 705 as shown by the arrows A. The vapor or aerosol then passes through the end wall 709 (via the one-way valve 714 if present) and into the tobacco composition containers 703*a*, 703*b* where it picks up flavor from the tobacco compositions 704*a*, 704*b*. Heat carried by the aerosol or vapor volatilizes nicotine or other volatiles from the tobacco compositions, which are then entrained in the passing vapor/aerosol. The vapor or aerosol can then exit the cartridge 700 through the end wall 715 of the tobacco composition containers as shown by the arrow B.

The examples shown in FIGS. 4 and 5 are particularly suitable for use with so-called modular or "e-go" products, in which the cartomizer is fitted to a battery section (not shown), typically by a screw thread, a bayonet fitting or the like. The cartomizer as a whole is typically discarded after use and a new, replacement cartomizer used. As an alternative, it may be possible for the user to re-use the cartridge by refilling the liquid and/or replacing the solid material from time to time as necessary.

The examples shown in FIGS. 4 and 5 may easily be adapted for use with other types of an electronic tobacco hybrid device, which are known per se. There are for example so-called "look alike e-cigarette" or "cig-alike" devices which are generally small and have a form and appearance similar to a conventional cigarette. In such devices, the liquid container typically includes some wadding material, of for example cotton or the like, for holding the liquid. The cartridge or cartomizer in such known devices is typically disposable as a whole, but it may be possible to refill the liquid and/or replace the solid material in examples that use an embodiment of the present invention. As another example, there are so-called tank devices or personal vaporizers which generally have large liquid containers for holding relatively large volumes of liquid and also provide for advanced functions that allow users to control a number of aspects of the device.

As an alternative to any of the cartomizer arrangements discussed above, the atomizer (i.e. the heater and the wick) for the liquid may be provided separately of the liquid and material containers. The atomizer may for example be provided as part of the battery section of the overall device to which the cartridge is detachably fitted by the user in use.

In any of the examples described above in relation to FIGS. 4 and 5, there may also be provided a heater for the tobacco compositions so as to "pre-heat" them. This heater may be provided as part of the cartridge or as part of the battery section of the device to which the cartridge is fitted in use. This heater for the tobacco compositions volatilizes nicotine and other volatiles present in the tobacco compositions, which are then entrained in the passing vapor/aerosol.

As used herein, "aerosol generating agent" refers to a compound or mixture that promotes the generation of an aerosol. An aerosol generating agent may promote the generation of an aerosol by promoting an initial vaporization and/or the condensation of a gas to an inhalable solid and/or liquid aerosol.

As used herein, "resistance to draw" refers to the pressure required to force air through the full length of the object under test at the rate of 17.5 milliliters per second at 22 degrees Celsius and 101 kilopascals (760 Torr). Resistance to draw is measured in accordance with ISO 6565:201 1.

As used herein, the "fluid" that passes through the tobacco chamber may be any liquid and/or gas. In some cases, it may be air that is drawn through the chamber and then combined with the aerosol and/or vapor that is generated from the volatilizable liquid. In some cases, it may comprise the aerosol and/or vapor that is generated from the volatilizable liquid.

In general, any suitable aerosol generating agent or agents may be included in the aerosol generating material of the invention. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor" and "flavoring" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

For the avoidance of doubt, where in this specification the term "comprises" is used in defining the disclosure or features of the disclosure, embodiments are also disclosed in which the invention or feature can be defined using the terms "consists essentially of" or "consists of" in place of "comprises".

For the avoidance of doubt, where in this specification the terms "first" and "second" are used to refer to compositions/chambers, there is no implicit disclosure of any order of use. "First" and "second" are simply used as a tool for referencing different compositions or chambers. Features discussed in relation to one chamber or composition are explicitly disclosed in relation to each chamber or composition, as appropriate.

The above embodiments are to be understood as illustrative examples of the disclosure Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure, which is defined in the accompanying claims.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A device for generating an inhalable medium, the device comprising:

a container for holding a liquid;

a heater for volatilizing liquid held in the container;

a first chamber containing a first composition;

a second chamber containing a second composition; and an outlet;

wherein the device is configured such that in use, an inhalable medium passes out of the outlet, the medium comprising (i) volatilized liquid in the form of at least one of a vapor or and/or an aerosol and (ii) one or more constituents of at least one of the first and/or second compositions; and such that a relative fluid flow rate through the first chamber and the second chamber changes during use, wherein the resistance to flow through the first chamber changes as a result of exposure to at least one of the vapor and the aerosol, such that the relative fluid flow rate through the first and second chambers changes during use.

2. The device according to claim 1, wherein the device is configured such that in use, liquid volatilized by the heater passes, in the form of at least one of a vapor and an aerosol, through the first chamber and the second chamber to thereby entrain one or more constituents from the first composition and the second composition to produce the inhalable medium which passes out of the outlet, wherein the relative flow rate of the at least one of the vapor or the aerosol through the first chamber and the second chamber changes during use.

3. The device according to claim 1, wherein at least one of:

an initial flow rate through the second chamber is substantially zero, or a final flow rate through the first chamber is substantially zero.

4. The device according to claim 1, further comprising a degradable material which initially blocks fluid flow through the second chamber, wherein the degradable material is selected such that the degradable material degrades in use.

5. The device according to claim 1, wherein an initial average particle size of the first composition is greater than an initial average particle size of the second composition.

6. The device according to claim 1, wherein a mesh is provided in at least one of the first chamber or the second chamber to modulate a resistance to draw through the respective chamber.

7. A method of generating an inhalable medium using the device according to claim 1, the method comprising:

volatilizing the liquid held in the container;

forming an inhalable medium, the inhalable medium comprising (a) the volatilized liquid in the form of at least one of a vapor or an aerosol and (b) one or more constituents of at least one of the first and/or second compositions;

passing the inhalable medium out of the outlet; and changing a relative fluid flow rate through the first chamber and the second chamber during use, wherein the resistance to flow through the first chamber changes as a result of exposure to the vapor and/or aerosol, such that the relative fluid flow rate through the first and second chambers changes during use.

8. The method according to claim 7, further comprising:

entraining one or more constituents from the compositions in at least one of a vapor or an aerosol formed by the volatilized liquid by passing the at least one of the vapor or the aerosol through the compositions to generate the inhalable medium, wherein the relative flow rate of the at least one of the vapor or the aerosol through the first chamber and/or the second chamber changes during use; and passing the inhalable medium out of the outlet.

9. The device according to claim 1, wherein, upon use of the device, particles in the first chamber absorb condensates and expand, gradually increasing resistance to flow and consequently increasing the proportion of the vapor and/or aerosol that passes through the second chamber.

10. The device according to claim 1, wherein the first composition and/or the second composition is a tobacco composition.

11. A pod containing a first composition in a first chamber and a second composition in a second chamber, wherein the pod is configured for use in a device as claimed in claim 1.

12. A kit comprising:

(i) a first pod containing a volatilisable liquid; and (ii) a second pod, containing a first composition in a first chamber and a second composition in a second chamber, wherein the first and second pods are configured for use in a device as claimed in claim 1.

13. A cartridge for use in a device for generating an inhalable medium, the cartridge comprising:

a volatilizable liquid in a first container;

a first composition in a first chamber; and a second composition in a second chamber, wherein the cartridge is configured such that in use in the device, a relative fluid flow rate through the first chamber and the second chamber changes over time, wherein the resistance to flow though the first chamber changes as a result of exposure to the vapor and/or aerosol, such that the relative fluid flow rate through the first and second chambers changes during use.

14. The cartridge according to claim 13, wherein the cartridge is configured such that in use, liquid volatilized by a heater of the device passes, in the form of at least one of a vapor or an aerosol, through the first chamber and the second chamber to thereby entrain one or more constituents from the first composition or the second composition to produce the inhalable medium which passes out of an outlet of the device, wherein a relative flow rate of the at least one of the vapor or the aerosol through the first chamber and the second chamber changes during use.

15. The cartridge according to claim 13, wherein in use, at least one of:

an initial flow rate through the second chamber is substantially zero, or a final flow rate through the first chamber is substantially zero.

16. The cartridge according to claim 13, further comprising a degradable material which initially blocks fluid flow through the second chamber, wherein the degradable material is selected such that the degradable material degrades in use.

17. The cartridge according to claim 13, wherein an initial average particle size of the first composition in the first chamber is greater than an initial average particle size of the second composition in the second chamber.

18. The cartridge according to claim 13, wherein a mesh is provided in at least one of the first chamber or the second chamber to modulate a resistance to draw through the respective chamber.

19. The cartridge according to claim 13, wherein, upon use of the device, particles in the first chamber absorb condensate and expand, gradually increasing resistance to flow and consequently increasing the proportion of the vapor and/or aerosol that passes through the second chamber.

20. A tobacco composition pod, containing a first tobacco composition in a first chamber and a second tobacco composition in a second chamber;

wherein the tobacco composition pod is configured for use in a device for use in generating an inhalable medium, the device being such that a relative fluid flow rate through the first chamber and the second chamber changes during use, wherein the resistance to flow through the first chamber changes as a result of exposure to at least one of the vapor and the aerosol, such that the relative fluid flow rate though the first and second chambers changes during use.

21. A kit comprising:

a liquid pod containing a volatilizable liquid; and the tobacco composition pod as claimed in claim 20 containing a first tobacco composition in a first chamber and a second tobacco composition in a second chamber;

wherein the liquid pod and the tobacco composition pod are configured for use in a device for use in generating an inhalable medium, the device being such that in use, an inhalable medium is generated, the medium comprising (i) volatilized liquid from the liquid pod in the form of at least one of a vapor or an aerosol and (ii) one or more constituents of the first tobacco composition and the second tobacco composition; the device being such that a relative fluid flow rate through the first chamber and the second chamber of the tobacco composition pod changes during use, wherein the resistance to flow through the first chamber changes as a result of exposure to the vapor and/or aerosol, such that the relative fluid flow rate through the first and second chambers changes during use.

22. A method of providing sustained release of nicotine from the device for generating an inhalable medium, the device comprising:

a container for holding a liquid;

a heater for volatilising liquid held in the container;

a first chamber containing a first tobacco composition;

a second chamber (13*b*) containing a second tobacco composition; and an outlet;

the device being configured such that in use, an inhalable medium passes out of the outlet, the medium comprising (i) volatilized liquid in the form of at least one of a vapor or an aerosol and (ii) one or more constituents of at least one of the first tobacco composition or the second tobacco composition such that a relative fluid flow rate through the first chamber and the second chamber changes during use, wherein the resistance to flow through the first chamber changes as a result of exposure to the vapor and/or aerosol, such that the relative fluid flow rate through the first and second chambers changes during use.

* * * * *